US005386998A

United States Patent [19]

Mader et al.

[11] Patent Number: 5,386,998

[45] Date of Patent: Feb. 7, 1995

[54] MATH GAME APPARATUS

[76] Inventors: Rosemary L. Mader; Leonard J. Mader, both of 16534 Franklin Trail #2A, Prior Lake, Minn. 55372

[21] Appl. No.: 123,048

[22] Filed: Sep. 20, 1993

[51] Int. Cl.[6] ..... A63F 3/00

[52] U.S. Cl. ..... 273/237; 273/268

[58] Field of Search ..... 273/459, 142 R, 142 J, 273/142 JC, 268, 237

[56] References Cited

U.S. PATENT DOCUMENTS

| | | | |
|---|---|---|---|
| 2,720,399 | 10/1955 | Pattyn | 273/142 JCX |
| 3,747,934 | 7/1973 | Barrett | 273/268 |
| 4,410,182 | 10/1983 | Francis | 273/268 |
| 4,421,315 | 12/1983 | Cutler | 273/268 |

FOREIGN PATENT DOCUMENTS

| | | | |
|---|---|---|---|
| 76561 | 12/1948 | Czechoslovakia | 273/142 JC |

OTHER PUBLICATIONS

Francis Products, Inc. Advertising Circular, May 1982 Run-The-Gamut.

*Primary Examiner*—Paul E. Shapiro

*Attorney, Agent, or Firm*—E. Michael Combs

[57] ABSTRACT

A container member is arranged to include a surrounding wall, having a first support wall arranged to accommodate a row of peg members, that in turn are rotatably mounted about an axle, with a second support wall spaced from the first support wall and axle to accommodate the peg members upon rotation of the peg members from the first support wall, such that each peg member includes a digital enumeration upon an end wall of a respective peg member. Upon the throwing of dice onto the floor of the container, the total of the dice thusly rolled is replicated by the enumeration of the peg members until further replication by further throwing of the dice is not available.

4 Claims, 4 Drawing Sheets

FIG. 1
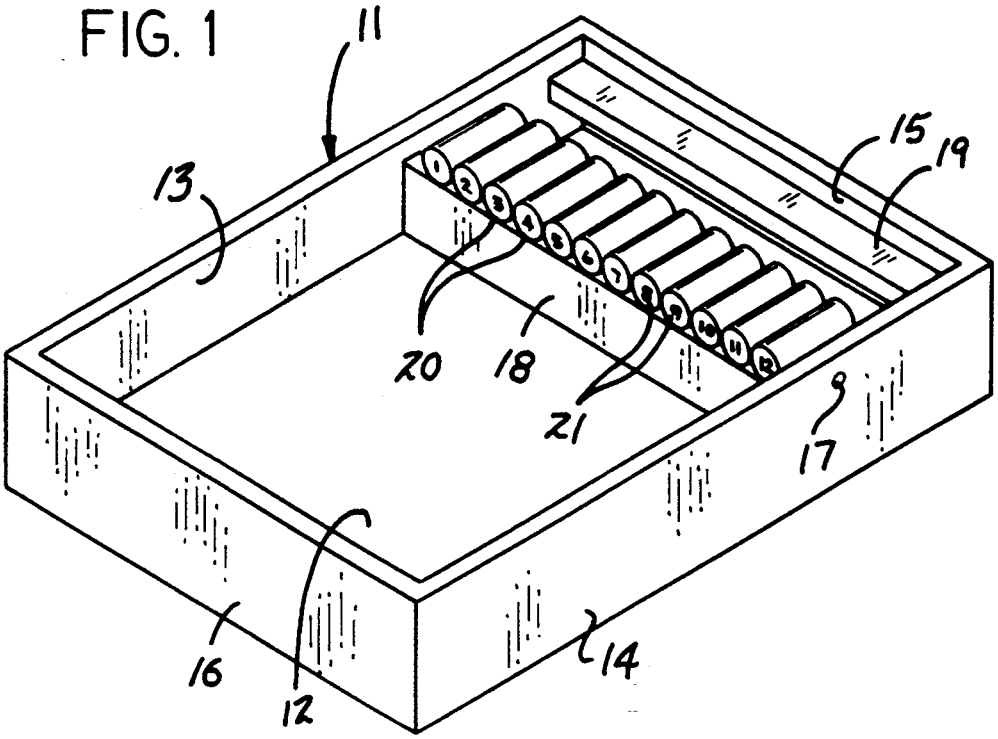
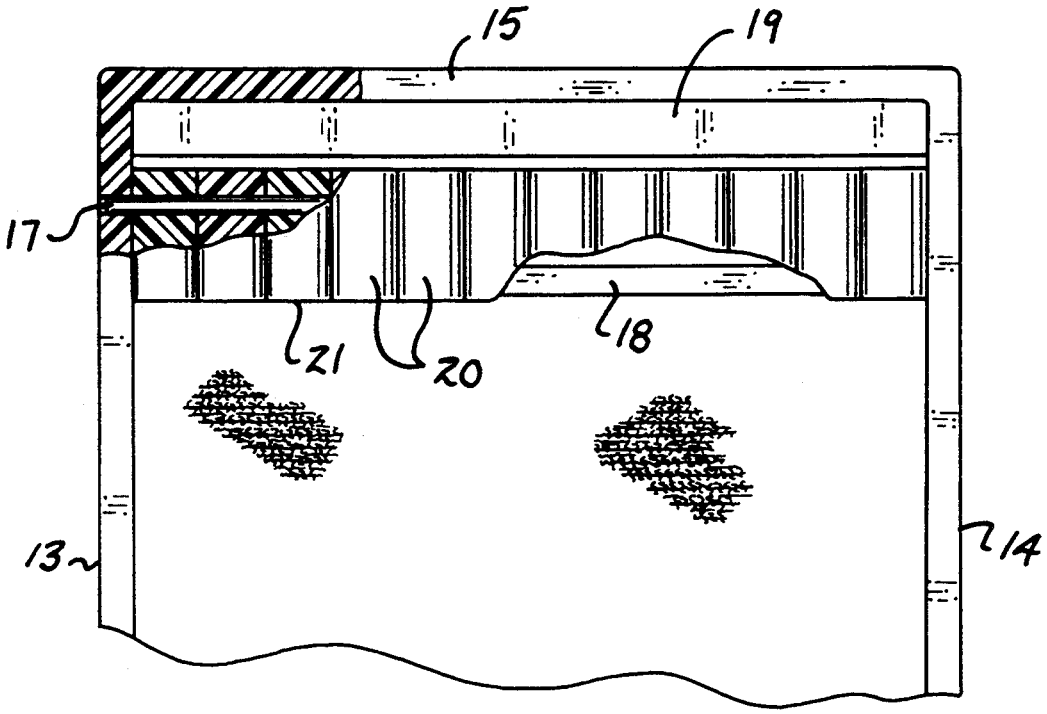
FIG. 2

MATH GAME APPARATUS

BACKGROUND OF THE INVENTION

1. Field of the Invention

The field of invention relates to game apparatus, and more particularly pertains to a new and improved math game apparatus wherein the same is directed to the employment of a math game structure for replication of numbers dictated by rolling of dice and the like.

2. Description of the Prior Art

Game apparatus of various types are utilized throughout the prior art wherein U.S. Pat. Nos. 5,102,339; 4,883,277; 4,565,374; and 4,452,588 are examples of mathematical game structure of various configurations, wherein the instant invention attempts to overcome deficiencies of the prior art by providing for apparatus to associate rotary pegs relative to the throwing of dice to indicate a total available to be achieved by the throwing of dice relative to an individual player's turn.

SUMMARY OF THE INVENTION

In view of the foregoing disadvantages inherent in the known types of math game apparatus now present in the prior art, the present invention provides a math game apparatus wherein peg members having enumeration thereon are available for rotation relative to total directed by the throwing of dice. As such, the general purpose of the present invention, which will be described subsequently in greater detail, is to provide a new and improved math game apparatus which has all the advantages of the prior art math game apparatus and none of the disadvantages.

To attain this, the present invention provides a container member arranged to include a surrounding wall, having a first support wall arranged to accommodate a row of peg members, that in turn are rotatably mounted about an axle, with a second support wall spaced from the first support wall and axle to accommodate the peg members upon rotation of the peg members from the first support wall, such that each peg member includes a digital enumeration upon an end wall of a respective peg member. Upon the throwing of dice onto the floor of the container, the total of the dice thusly rolled is replicated by the enumeration of the peg members until further replication by further throwing of the dice is not available.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved math game apparatus which has all the advantages of the prior art math game apparatus and none of the disadvantages.

It is another object of the present invention to provide a new and improved math game apparatus which may be easily and efficiently manufactured and marketed.

It is a further object of the present invention to provide a new and improved math game apparatus which is of a durable and reliable construction.

An even further object of the present invention is to provide a new and improved math game apparatus which is susceptible of a low cost of manufacture with regard to both materials and labor, and which accordingly is then susceptible of low prices of sale to the consuming public, thereby making such math game apparatus economically available to the buying public.

Still yet another object of the present invention is to provide a new and improved math game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the math game structure.

FIG. 2 is an orthographic top view, partially in section, of the peg members mounted relative to the container of the invention.

DESCRIPTION OF THE PREFERRED EMBODIMENT

Figure 3:
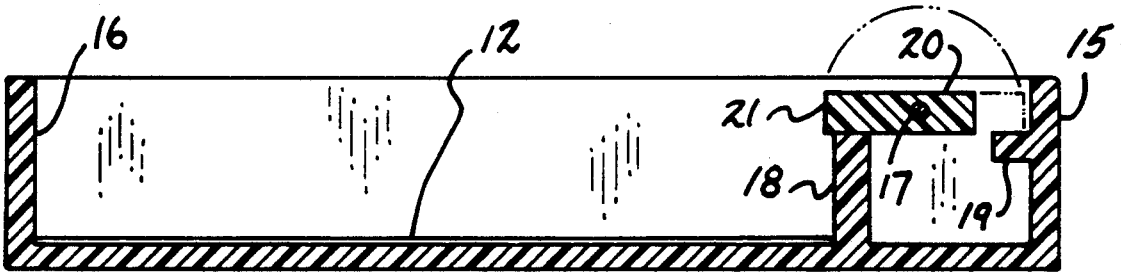
FIG. 3 is an orthographic side view, taken in cross section, of the container structure and the rotation of the pegs available therewithin.

With reference now to the drawings, and in particular to FIGS. 1 to 8 thereof, a new and improved math game apparatus embodying the principles and concepts of the present invention and generally designated by the reference numerals 11–41 will be described.

Figure 4:
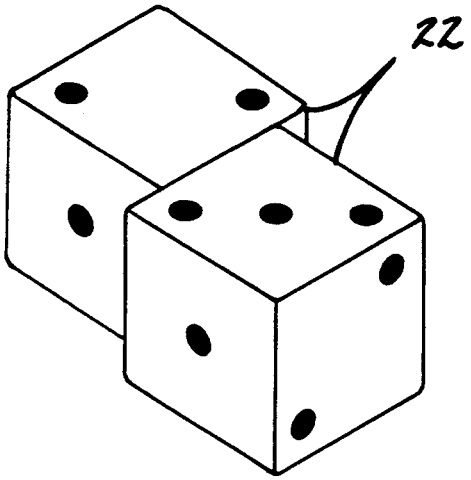
FIG. 4 is an isometric illustration of typical dice members employed by the invention.

More specifically, the math game apparatus of the instant invention essentially comprises a container 11, having a floor 12 including a first side wall 13 spaced from a second side wall 14, and a first end wall 15 spaced from a second end wall 16. An axle 17 is directed between the first and second side walls 13 and 14 spaced above the floor 12. A first support wall 18 is spaced between the axle 17 and the second end wall 16, with the first support wall 18 projecting to the floor 12. A second support wall 19 along the first end wall 15 within the container 11 is spaced between the axle 17 and the first end wall, as illustrated in FIG. 1 for example. A row of peg members 20 are rotatably mounted about the axle 17 such that the first support wall 18 receives the pegs thereon in a first position, with the second support wall 19 receiving the pegs when the pegs are rotated in a second position, as illustrated in phantom in FIG. 3. The peg members of the row of peg members 20 include a numbered end wall 21. At least a plurality of dice members 22 are provided, wherein the number of dice members 22, such as illustrated in FIG. 4, are optionally employed by the players depending upon the enumeration and quantity of pegs 20 employed. To this end, the dice members are directed upon the floor 12 within the container and the numbers thusly derived is replicated by a like total of the numbered end walls. Upon the peg members 20 being rotated upon using the selective peg members to attain the total derived by throwing of the dice members 22, that peg member is rotated to the second position, as illustrated in FIG. 3, along with whatever quantity of peg members are required for that attainment of a dice generated number. An individual player repeats the throwing of the dice and the rotation of the peg members to replicate the numbers thusly derived by the dice until a penultimate number directed by the dice is no longer attainable by the remaining available peg members 20.

Figure 5:
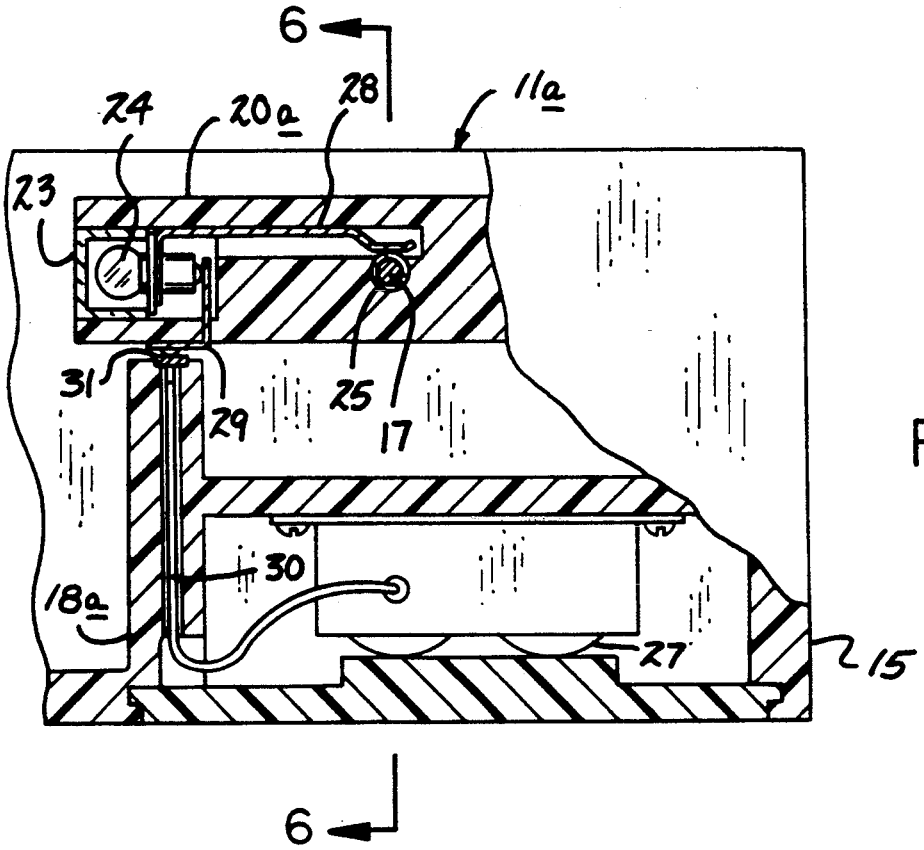
FIG. 5 is an orthographic cross-sectional illustration of a modified container structure indicating illuminated peg members.
Figure 6:
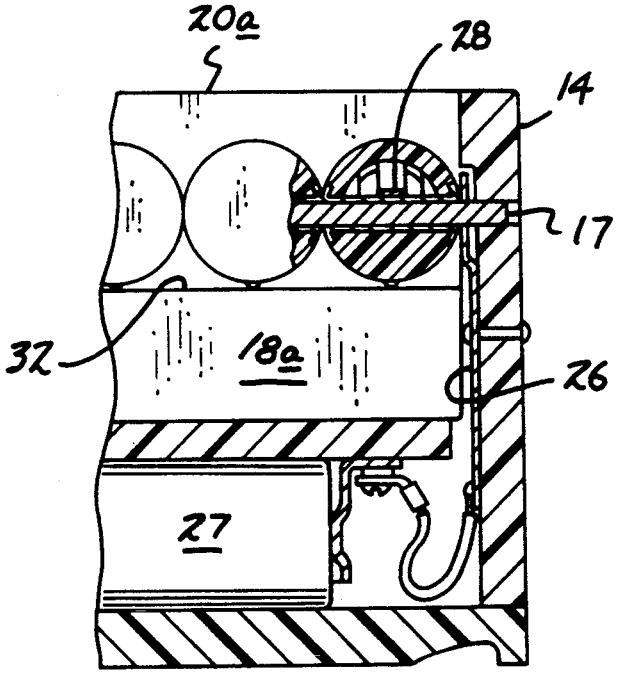
FIG. 6 is an orthographic view, taken along the lines 6—6 of FIG. 5 in the direction indicated by the arrows.

The FIG. 5 indicates the use of a modified container 11*a*, having a modified first support wall 18 such that the peg member includes a peg end wall transparent window 23, with an illumination bulb 24 positioned within the peg member in adjacency to the window. The axle 17 includes a metallic axle sheath 25 directed along the axle in communication with a ground plate 26 within the second side wall 14 in communication with the batteries 27 mounted upon the floor 12 between the first support wall 18*a* and the first end wall 15. An illumination bulb spring contact plate 28 directed from the illumination bulb body is in constant communication with the sheath 25 permitting rotation along with the sheath along with rotation of the peg member 28 from the first position to the second position as noted above. An illumination bulb second contact plate 29 is directed from the illumination bulb positive terminal to position exteriorly of an associated peg member 20*a* in communication with a primary contact line 30 in electrical communication with the batteries 27 through a button 31 mounted upon the first support wall top surface 32. In this manner when the pegs are in the first position, illumination of each bulb 24 is effected to indicate remaining available pegs and the available numbers for enhanced amusement and ease of viewing of the numbers. Upon rotation of the pegs to the second position, the second contact plate 29 is displaced from the button 31 and the bulb 24 and its illumination is ceased.

Figure 7:
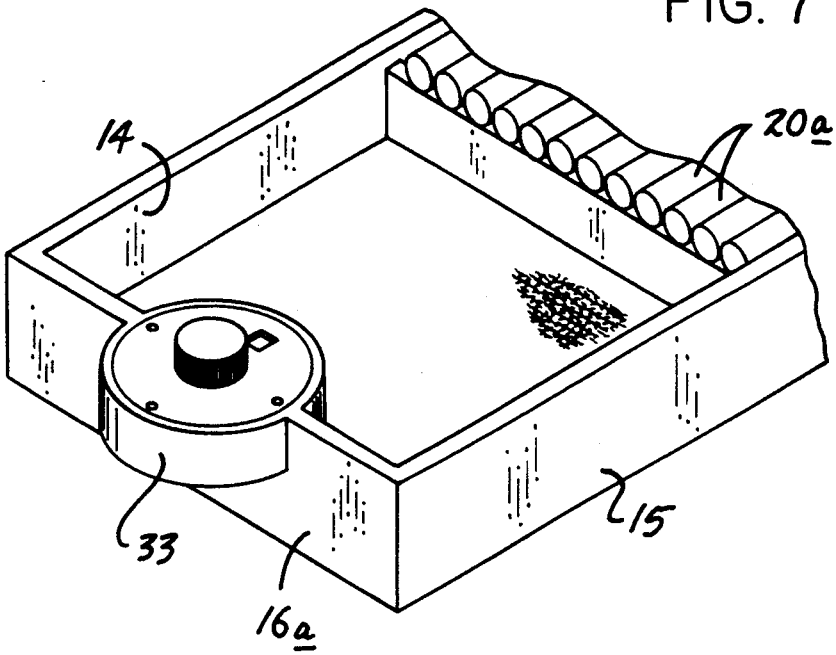
FIG. 7 is an isometric illustration of a modified end wall structure of the container.
Figure 8:
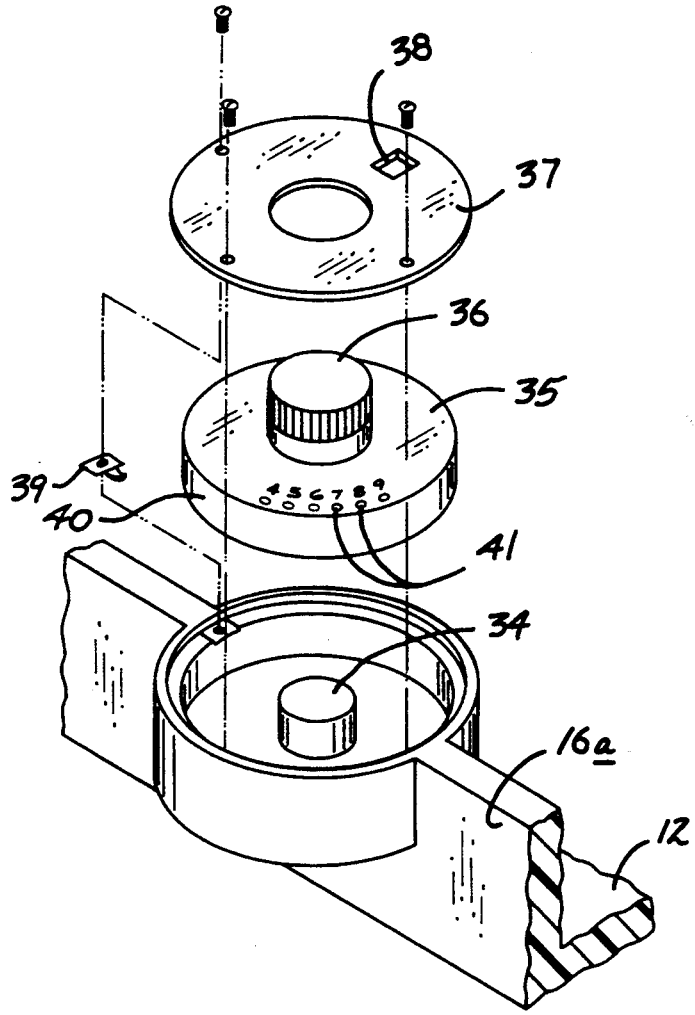
FIG. 8 is an enlarged isometric illustration, in exploded view, of the rotary dial structure, as indicated in FIG. 7.

The FIGS. 7 and 8 indicates the optional employment of the second end wall 16 having a cylindrical housing 23 contained medially thereof, with the cylindrical housing including a central axle 34 mounted to the housing floor, with a rotary dial 35 rotatably mounted about the central axle 34. The rotary dial includes a hub 36 projecting above the rotary dial through a cover plate 37, that in turn is affixed onto cylindrical housing 33. The cover plate 37 includes a cover plate window 38 for viewing of an individual one of an annular array of numbers 41 on the rotary dials top surface. Further, a spring finger brake 39 may be employed mounted within the cylindrical housing in communication with the rotary dial side wall 40 to frictionally brake and limit rotation of the dial within the housing for generation of an individual number of the array of numbers 41 for matching with individual of the peg members 20*a*, in a manner as described above.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A math game apparatus, comprising, a container, the container having a floor, a first side wall spaced from a second side wall, and a first end wall spaced from a second end wall, and an axle extending between the first side wall and the second side wall spaced above the floor, and between the first end wall and the second end wall, and a row of peg members rotatably mounted about the axle, each peg member having a peg member numbered end wall, with each numbered end wall including a digital enumeration imparted therein, and at least one dice member, with the at least one dice member directed to generate a predetermined number total and to replicate that number total by rotation of sufficient of said peg members to duplicate the total, each said numbered end wall of said sufficient peg members equalling said total, and a first support wall extending between the first side wall and the second side wall and between the axle and the second end wall for receiving each peg member thereon in the first position, wherein the first support wall is positioned between the axle and the floor, and a second support wall oriented between the axle and the first end wall for receiving each peg member upon rotation of each said peg member to a second position from a first position, wherein each said peg member of said row of peg members is received upon said first support wall, and at least one of said peg members having a transparent window in said numbered end wall of said at least one of said peg members, and illumination means in said at least one of said peg members for directing illumination through said transparent window in said first position.

2. An apparatus as set forth in claim 1 wherein each said numbered end wall includes a transparent window, with the illumination means comprising an illumination bulb positioned within at least one of said peg members in adjacency to said window, said axle having a metallic sheath oriented thereabout, and at least one battery mounted within the container between the first support wall and the second support wall, and a ground plate extending from said metallic sheath to said at least one battery, and a first spring contact plate extending from said illumination bulb into electrical communication with said metallic sheath, and a second contact plate extending from said illumination bulb through at least one of said peg members, with a primary contact line extending through the first support wall into electrical communication with the said battery, and the primary contact connector line projecting through said first support wall and a top surface of said first support wall, with a button imparted on said top surface for communication with said second contact plate when at least one of said peg members is in the first position for affecting illumination of said illumination bulb in the first position.

3. An apparatus as set forth in claim 2 wherein the second end wall includes a cylindrical housing having a central axle, and a rotary dial rotatably mounted about the central axle, and the rotary dial having a hub and a rotary dial top wall, with the rotary dial top wall including an annular array of numbers and a cover plate receiving said hub therethrough, and the cover plate having a cover plate window, with the cover plate window arranged for viewing of an individual number of said annular array of numbers.

4. An apparatus as set forth in claim 3 including a spring finger brake mounted within the said cylindrical housing, and the rotary dial having a cylindrical side wall, with the spring finger brake arranged for communication with said cylindrical side wall to effect braking of the rotary dial upon its rotation.

* * * * *